US005435560A

United States Patent [19]

Kehoe

[11] Patent Number: 5,435,560

[45] Date of Patent: Jul. 25, 1995

[54] GOLF PUTTING AND CHIPPING TARGET

[76] Inventor: Robert P. Kehoe, 1515 Beechurst Ct., Houston, Tex. 77062

[21] Appl. No.: 248,349

[22] Filed: May 24, 1994

[51] Int. Cl.[6] ..... A63B 57/00; A63B 69/36

[52] U.S. Cl. ..... 273/181 R; 273/177 R; 273/183.1

[58] Field of Search ..... 273/181 R, 34 R, 35 R, 273/177 R, 183.1

[56] References Cited

U.S. PATENT DOCUMENTS

| | | | |
|---|---|---|---|
| 1,616,236 | 2/1927 | Schacht | 273/100 |
| 1,619,580 | 3/1927 | Long | 273/127 |
| 2,635,874 | 4/1953 | Rath | 273/177 R |
| 2,737,392 | 3/1956 | Stokes | 273/177 |
| 3,048,405 | 8/1962 | McCaul | 273/177 |
| 3,081,090 | 3/1963 | Congleton | 273/177 R X |
| 3,114,556 | 12/1963 | Miller | 273/178 |
| 3,490,769 | 1/1970 | Torbett | 273/181 R |
| 3,659,856 | 5/1972 | Fatur | 273/177 R |
| 4,017,084 | 4/1977 | Jeffery | 273/176 FB |
| 4,368,888 | 1/1983 | Ren | 273/176 FB |
| 4,560,167 | 12/1985 | Perreau | 273/184 A |
| 4,861,033 | 8/1989 | Miner | 273/177 R |
| 4,936,583 | 6/1990 | Peabody | 273/177 R |
| 5,013,042 | 5/1991 | Garnes | 273/184 A |
| 5,060,952 | 10/1991 | Brill | 273/186 C |
| 5,205,559 | 2/1993 | Plopper | 273/177 R |

FOREIGN PATENT DOCUMENTS

| | | | |
|---|---|---|---|
| 490717 | 2/1953 | Canada | 273/181 R |
| 609428 | 11/1960 | Canada | 273/177 R |

*Primary Examiner*—William H. Grieb

[57] ABSTRACT

A practice putting and chipping target simulating a real golf hole comprised of a thin, flexible circular disk 10 with a centrally located, solid, dark colored circle 12 which simulates a conventional golf hole surrounded by a contrasting, light colored border 16 and used as a putting and chipping target from any distance on the same geometric plane. A 430 mm (17") long strip of adhering material 22 is located approximately 430 mm (17") beyond the simulated hole perpendicular to and bisected by the intended line of the practice stroke 26. Knowing that the optimum speed for a putt or chip would leave the golf ball approximately 430 mm (17") beyond the simulated hole provides direct visual feedback to the golfer. For practicing very short putts, a special visual aiming target 14 is present to aid the golfers concentration.

10 Claims, 1 Drawing Sheet

GOLF PUTTING AND CHIPPING TARGET

BACKGROUND-FIELD OF INVENTION

This invention relates to golf putting and chipping targets. Specifically, where a visually representative practice hole is needed that allows the golfer to practice from any distance with direct visual feedback that the line was correct and the speed of the stroke was optimum.

BACKGROUND DISCUSSION OF PRIOR ART

Both putting and chipping are great tests of skill requiring regular, high-quality practice sessions. Golfers typically practice putting and chipping wherever they can find a suitable surface, either outdoors or indoors. In many cases, a carpeted surface indoors must suffice for practice putting and chipping for reasons of inclement weather, time or convenience. In these and similar cases, the golfer has a need for a visually representative putting and chipping target that provides feedback on both the line and speed of the practice stroke similar to an actual golf hole. Preferrably, a practice set-up that does not impede the natural movement of the golf ball significantly.

Many inventors have created practice putting and chipping targets or training devices. These devices have tended to be mechanically or electrically complicated; expensive to manufacture; contained a means to capture and return the golf ball; or lacked the necessary feedback to tell the golfer that the ball was optimally stroked. That is, not only on line but more importantly, at the correct speed to have the greatest chance of being captured by the hole.

Examples of different types are found in U.S. Pat. Nos.,

McCaul U.S. Pat. No. 3,048,405 is of interest but lacks a realistic method of feedback to tell the golfer if the ball was putted at the optimum speed.

Perreau U.S. Pat. No. 4,560,167 is of interest since it attempts to simulate a golf hole. However, this expensive, electrical device relies on an electronic detector to determine if the putt was probably successful rather than by providing direct, visual feedback to the golfer. This device must be used where electricity is available and its use is quite far removed from an actual putting situation because of the nature of its construction.

Peabody U.S. Pat. No. 4,936,583 is of interest since it shows an actual photograph of a golf hole. There are two primary drawbacks with the Peabody device; first, it only accomodates two predetermined putting distances out of an infinite number; and second, there is no visual feedback if the speed of the ball was optimum as it rolled over the top of the hole. Because it uses predetermined rather short distances it is not suitable or practical for a chipping target either.

Garnes U.S. Pat. No. 5,013,042 is of interest since it attempts to simulate a golf hole. However, putting with the object of causing a collision between two golf balls fails to provide the golfer feedback on the distance the ball would have rolled past the hole.

Many other devices such as Plopper U.S. Pat. No. 5,205,559; Brill U.S. Pat. No. 5,060952; Miner U.S. Pat. No. 4,861,033; Ren U.S. Pat. No. 4,368,888; Jeffery U.S. Pat. No. 4,017,084; Fatur U.S. Pat. No. 3,659,856; Miller U.S. Pat. No. 3,114,556; Stokes U.S. Pat. No. 2,737,392; Long U.S. Pat. No. 1,619,580; Schacht U.S. Pat. No. 1,616,236; use various elements such as rails, boards, ramps, mechanical devices to capture or guide the ball. The introduction of these elements is contrary to the nature of putting under conditions that are as close as possible to actual playing conditions. Specifically, no correlation is available for converting the effect of a golf ball going up a ramp to how the putt would have done on an actual horizontal putting surface. Additional examples lacking correlation are; putting up a board or rail; putting to a capture device; and generally putting to any device that does not allow the ball to roll unimpeded to, over and past the hole. The main drawback of mechanical devices that capture the ball is that the golfer does not know if the putt or chip was at the optimum speed to be captured by the actual hole. This feedback is essential to learning to stroke the ball with the optimum force generating the optimum speed that would cause the ball to stop within 430 mm (17") of the back of the hole.

Based on his research, the distance of 430 mm (17") has been established by Pelz[1] as the optimum distance which a golf ball would roll past the hole, if it missed, to have the greatest chance of being captured by the hole. Depending on specific grass types and environmental conditions, 430 mm (17") can vary either longer or shorter; however the 430 mm (17") dimension is the best case number for overall usage.

References: 1 Pelz, Dave; Putt Like The Pros; *HarperPerennial;* 1991 page 129.

OBJECTS AND ADVANTAGES

Accordingly, several objects and advantages of the present invention are:

a) to provide a putting and chipping target that is visually representative for all practice distances
b) to provide a putting and chipping target that indicates if the putted or chipped ball has stopped within 430 mm (17") of the back of the simulated hole
c) to provide a putting and chipping target that allows practice on the same geometric plane
d) to provide a putting target that has a special visual aiming target for practicing very short putts
e) to provide a putting and chipping target that is easily manufactured at a low cost
f) to provide a putting and chipping target that does not require mechanical or electrical devices to operate
g) to provide a putting and chipping target that travels easily with the golfer
h) to provide a putting and chipping target that is easily relocatable while practicing
i) to provide a chipping target that is useful for all the above reasons Further objects and advantages, of my putting and chipping target will become apparent from consideration of the drawing and ensuing description. My putting and chipping target best approximates the realities of actual putting and chipping without being encumbered by; ramps, rails, boards, capture devices; a ball return or complex mechanical or electrical devices; while indicating if the ball would have stopped within 430 mm (17") of the back of the hole.

DRAWING FIGURES

FIG. 1 shows a perspective view of the entire set up including a golf club, a golf ball and the putting and chipping target.

FIG. 2 shows a close up, perspective view of the putting and chipping target.

FIG. 3 shows a close up, front elevation of the putting and chipping target.

REFERENCE NUMERALS IN DRAWINGS

10 a thin, flexible disk
12 a solid, dark colored circle of 108 mm (4¼") diameter
14 a special visual aiming target
16 a broad light colored, annular border
18 a regulation golf ball
20 a putting or chipping surface
22 a 430 mm (17") long by 12 mm (½") wide strip of adhering material
24 a golf club (putter or chipping iron)
26 a line representing the intended line of a putting or chipping stroke

Figure 1:
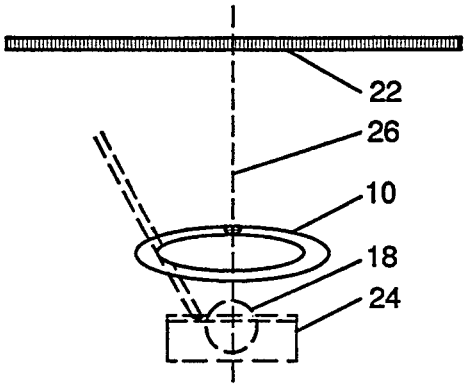
FIG. 1

Illustrates an eye level perspective view of a typical setup for a putting or chipping practice session. The golfer aligns the golf club 24 with a golf ball 18 and the target disk 10 along the intended stroke line 26. After the golfer makes a stroke he or she then checks to see if the golf ball 18 has rolled over the dark circle 12 and then stopped before going beyond the 430 mm (17") long strip of adhering material 22. All successful strokes from either putting or chipping will have passed over the dark circle 12 and stopped before going beyond the 430 mm (17") long strip of adhering material 22.

FIG. 2

The putting and chipping target 10 is a substantially circular disk which is quite flexible and can be made from a number of plastic, vinyl, neoprene rubber or other flexible materials of uniform cross-section which receive printing, laminating, adhesive labeling or similar methods of marking. At the center of the putting and chipping target is a solid, dark-colored circle 12 approximating and simulating the size and look of an actual golf hole, approximately 108 mm (4¼") in diameter. Surrounding and visually enhancing the simulated golf hole 12 is a thick border of solid contrasting color 16. At the back of the hole located within the area of the border 16, is a small special visual aiming target 14 for the purposes of training the eye to look at the back of the hole when practicing short putts. A golf ball 18 is illustrated to convey scale. Approximately 430 mm (17") behind the hole and perpendicular to the intended line of the stroke 26 is a strip of adhering material 22 which the ball must stop before crossing.

FIG. 3

The putting and chipping target 10 is lying on the putting or chipping surface 20 with a golf ball 18 shown for scale.

From the description above a number of advantages of my putting and chipping target become evident:

a) until the moment that a golf ball rolls over the top of the hole 12, the golfer is visually convinced that he or she is putting or chipping toward a visually representative hole on a level surface; not a mechanical or electrical device; up a ramp; on a board; on a rail; or to some other artificial means to deliver the ball to the hole quite unlike an actual golf hole.

b) the broad light colored border 16 visually enhances the simulated hole regardless of the color of the practice surface.

c) the special visual aiming target 14 is an aid in training the golfer to putt to the back of the hole when practicing short putts.

d) the simplicity and portability of the device is of great benefit because it requires only seconds to set up; does not require electrical power; is extremely compact for travel; and allows the golfer to putt and chip toward a hole of exactly the same size on the same plane as an actual golf hole.

e) the 430 mm (17") strip of adhering material 22 provides direct visual feedback to the golfer on the success of his stroke versus the optimum speed than the stroke should have had.

Figure 2:
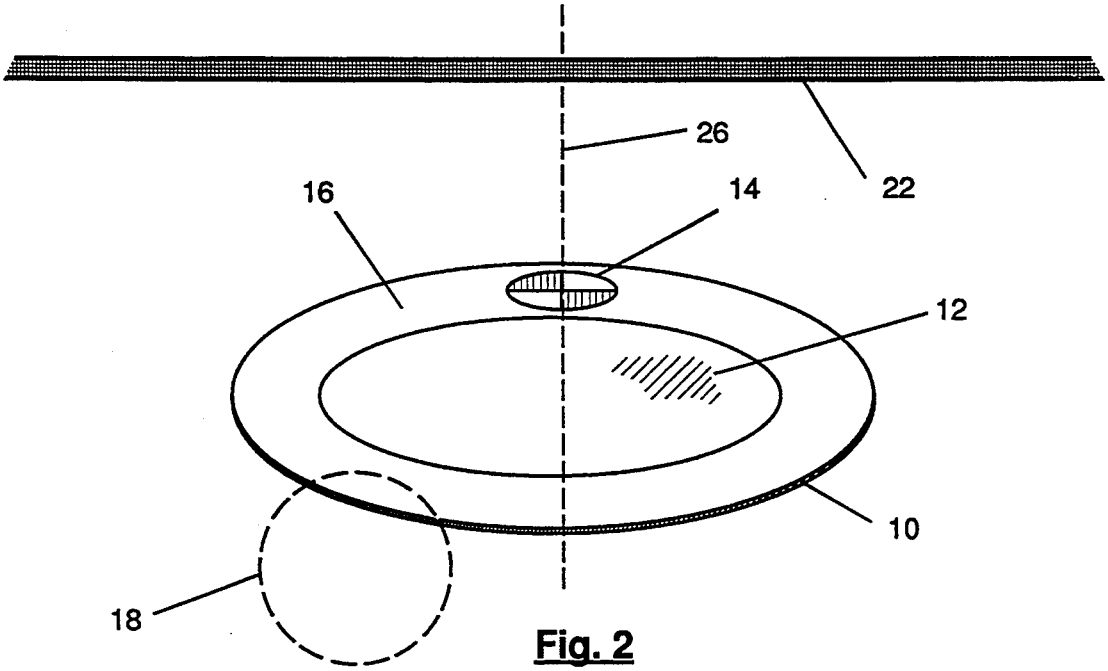
Figure 3:
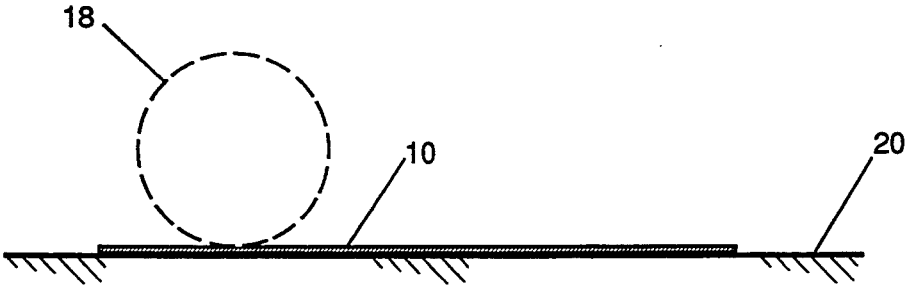

OPERATION—FIGS. 1, 2 and 3

The manner of use is to place the putting and chipping target 10 on the putting surface 20 with the special visual-aiming target 14 at the rear of the target. Next the golfer takes the 430 mm (17") long strip of adhering material 22 and measures along the line of the intended putt or chip for the full length of the strip starting at the back of the dark circle 12; and places the strip 22 perpendicular to and bisected by the intended line at that point. The golfer then practices putting or chipping the ball toward the target from any distance along the intended line 26 and notes if the golf ball(s) are stopping on or before the strip of adhering material 22.

A successful putting or chipping stroke is one in which the golfball rolls over the simulated hole 12 and stops approximately 430 mm (17") beyond the back of the hole.

Practicing chip shots is similar to practicing medium and long putts.

When practicing very short putts; approximately 6 feet of less, the golfer needs to train his eye to look at the special visual aiming target 14 to tell his brain that this is the back of the hole; thereby, not leaving the putt short. And by observing if the golf ball is stopping before it crosses the strip of adhering material 22, the golfer knows if the ball was struck with the optimum speed.

For advanced putting drills, the putting and chipping target allows the golfer to practice putting to one side or the other of the hole; thereby testing his or her accuracy on medium to short putts under simulated putting conditions.

The strip of adhering material 22 is made from the hook side of a hook and loop fastener when used on a carpeted surface. For use on a surface not suited to a hook type fastener, the strip of adhering material 22 may be made of another flexible material such as rubber, plastic or fabric that substantially lays flat.

SUMMARY, RAMIFICATIONS, AND SCOPE

Accordingly, the reader can see that the putting and chipping target can be easily used as a simple and highly effective practice aid:

it permits the golfer a visually representative putting and chipping target to be used at any distance without questioning whether the putt or chip would have arrived at the hole at the optimum speed because no ramps, rails, boards, or capture devices were used.

it allows the golfer to visually check the putt or chip for its entire roll without significant interuption of any kind much like actual putting and chipping situations.

it provides visual feedback to train the golfer to stroke the putt or chip at the optimum speed that would allow it to stop approximately 430 mm (17") beyond the hole.

it provides an effective training device for practicing very short putts and observing how far the putt would have rolled past the hole versus an optimum speed putt.

it provides an easy to use training aid that can be used on any suitable putting or chipping surface; either indoors or outdoors.

Finally, the simplicity of the design allows the golfer great freedom to use it wherever he or she may choose to conduct a practice session.

Although the description above contains many specifities, these should not be construed as limiting the scope of the invention but as merely providing illustrations of some of the presently prefered embodients of this invention. For example, the special visual aiming target could have a different shape or be covered or eliminated completely. The entire putting and chipping target could be printed or laminated on both sides. The entire 430 mm (17") strip of material could be wider, narrower, longer or made of different material or color. The strip of material could be located closer or further away from the back of the simulated hole than 430 mm (17").

Thus the scope of the putting and chipping target should be determined by the appended claims and their legal equivalents, rather than by the examples given.

What is claimed:

1. A golf practice putting and chipping target comprising:

a substantially circular disk of predetermined diameter and thickness;

said disk having a colored, centrally located circle approximately the size of a conventional golf hole;

said circle is surrounded by a wide, annular border of predetermined width and of contrasting color to said circle;

a strip of material of predetermined length and width that adheres, lies on or is attached to the practice putting or chipping surface;

said strip is located perpendicular to and bisected equally by the line of the intended stroke;

said strip to be located a predetermined distance beyond said circle as measured along the line of said stroke;

said distance of said strip beyond said circle and the length of said strip are substantially equivalent;

said strip to be made of a contrasting color to said practice surface;

whereby putting and chipping skills may be acquired during practice sessions by rolling a golf ball over the top of said disk and said circle from any distance along said line of intended stroke and; when said ball stops within said predetermined distance of the back of said circle and before crossing said strip the golfer knows that the putting or chipping stroke was made at the optimum speed or pace.

2. The structure of claim 1, wherein said border contains a special visual aiming target of predetermined diameter located at the back of said circle and within said border and along said line of intended stroke; whereby practicing short putts is accomplished with the additional use of said special visual aiming target.

3. The structure of claim 1 allowing horizontal access from any practice distance.

4. The structure of claim 1 being waterproof.

5. The structure of claim 1 being roughly similar in appearance on both sides.

6. A golf practice putting and chipping target comprising:

a substantially circular disk that lies on the practice putting or chipping surface;

said disk having a colored, centrally located circle;

said circle is surrounded by a wide, annular border of predetermined width and of contrasting color to said circle;

a strip of material that adheres, lies on or is attached to the practice putting or chipping surface;

said strip is located perpendicular to the line of the intended stroke;

said strip to be located a predetermined distance beyond said circle as measured along the line of the intended stroke;

said distance of said strip beyond said circle and the length of said strip are substantially equivalent;

said strip to be made of a contrasting color to said practice surface;

whereby putting and chipping skills may be acquired during practice sessions by rolling golf balls over the top of said disk and said circle from any distance along said line of intended stroke and; when said balls stop approximately at said predetermined distance of the back of said circle and before crossing said strip the golfer knows that the putting or chipping stroke was made at the optimum speed.

7. The structure of claim 6 contains a special visual aiming target and located at the back of said circle and contained within said border and centered along said line of intended stroke; whereby practicing short putts is accomplished with the additional use of said special target as the aiming point.

8. The structure of claim 6 allowing horizontal access from any practice distance.

9. The structure of claim 6 being weather resistant.

10. The structure of claim 6 being roughly similar in appearance on both sides.

* * * * *